US006111369A

United States Patent [19]

Pinchuk et al.

[11] Patent Number: 6,111,369

[45] Date of Patent: Aug. 29, 2000

[54] ELECTRONIC BALLAST

[75] Inventors: Dmitry Pinchuk, Bnei Brak; David Yoskovich, Rishon le Zion, both of Israel

[73] Assignee: Clalight Israel Ltd., Netanya, Israel

[21] Appl. No.: 09/215,952

[22] Filed: Dec. 18, 1998

[51] Int. Cl.[7] ..... G05F 1/00

[52] U.S. Cl. ..... 315/307; 315/244; 315/291; 315/94; 315/324; 315/DIG. 5

[58] Field of Search ..... 315/244, 209 R, 315/94, 106, 291, 307, 276, 290, 224, DIG. 5, DIG. 7, 324

[56] References Cited

U.S. PATENT DOCUMENTS

| | | | |
|---|---|---|---|
| 4,553,071 | 11/1985 | Boyd | 315/244 |
| 4,641,061 | 2/1987 | Munson | 315/210 |
| 4,893,064 | 1/1990 | Nilssen | 315/317 |
| 5,015,923 | 5/1991 | Nilssen | 315/307 |
| 5,021,714 | 6/1991 | Swanson et al. | 315/101 |
| 5,021,717 | 6/1991 | Nilssen | 315/324 |
| 5,068,576 | 11/1991 | Hu et al. | 315/291 |
| 5,107,184 | 4/1992 | Hu et al. | 315/291 |
| 5,175,470 | 12/1992 | Garbowicz | 315/106 |
| 5,208,511 | 5/1993 | Garbowicz | 315/106 |
| 5,426,350 | 6/1995 | Lai | 315/244 |
| 5,500,576 | 3/1996 | Russell et al. | 315/307 |
| 5,510,680 | 4/1996 | Nilssen | 315/209 |
| 5,563,473 | 10/1996 | Mattas et al. | 315/240 |
| 5,656,891 | 8/1997 | Luger et al. | 315/94 |
| 5,677,602 | 10/1997 | Paul et al. | 315/224 |
| 5,686,798 | 11/1997 | Mattas | 315/244 |
| 5,723,953 | 3/1998 | Nerone et al. | 315/307 |
| 5,739,645 | 4/1998 | Xia et al. | 315/307 |
| 5,747,941 | 5/1998 | Shackle et al. | 315/224 |

FOREIGN PATENT DOCUMENTS

| | | |
|---|---|---|
| 391383 | 10/1990 | European Pat. Off. . |
| 491434 | 6/1992 | European Pat. Off. . |
| 583838 | 2/1994 | European Pat. Off. . |
| 2744857 | 8/1997 | France . |
| 3301108 | 7/1984 | Germany . |
| 3608362 | 9/1987 | Germany . |
| 19634850 | 3/1998 | Germany . |
| 8400308 | 1/1984 | South Africa . |
| 9713391 | 4/1997 | WIPO . |
| 9809483 | 3/1998 | WIPO . |

OTHER PUBLICATIONS http://www.ortek.co.il/ballast.html (May 25, 1998) pp. 1–2.

*Primary Examiner*—Haissa Philogene
*Attorney, Agent, or Firm*—Edward Langer

[57] ABSTRACT

A ballast for providing electrical energy to one or more fluorescent bulbs having electrical discharge filaments. The ballast includes a pre-heating circuit having a first resonant frequency, coupled to pre-heat the filaments. An electron-discharge circuit having a second resonant frequency is coupled to ignite an electrical discharge through a gas between the filaments. Driver circuitry provides power to the pre-heating and electron-discharge circuits in succession, so as to ignite the one or more bulbs. The driver circuitry first provides power to the pre-heating circuit substantially at the first resonant frequency and subsequently provides power to the electron-discharge circuit substantially at the second resonant frequency.

12 Claims, 4 Drawing Sheets

ELECTRONIC BALLAST

FIELD OF THE INVENTION

The present invention relates generally to circuitry for use in fluorescent lamps, and specifically to high-frequency electronic ballasts for fluorescent lamps.

BACKGROUND OF THE INVENTION

It is known in the art to use a ballast circuit to heat the two filaments of a fluorescent bulb to a high temperature, such that when an electric field is applied between the filaments, they emit electrons and ionize the gas in the bulb. Responsive to radiation generated due to the electric current flowing through the gas, phosphors coating the inner surface of the bulb fluoresce, emitting visible light. The ballast typically controls both the initial ignition and the steady-state operation of the bulb.

U.S. Pat. No. 5,021,714 to Swanson et al., whose disclosure is incorporated herein by reference, describes a circuit for starting and operating fluorescent bulbs from an AC low-frequency power source. A ballast generates a voltage, whose frequencies include a plurality of harmonics of the power-source frequency, which voltage causes a capacitor and a cathode heating transformer to resonate responsive to the harmonics. The resonant voltage is applied across the fluorescent bulbs to aid the starting of their discharge, and thereafter the bulbs operate at the AC power source frequency.

U.S. Pat. No. 5,723,953 to Nerone et al., whose disclosure is incorporated herein by reference, discloses a high voltage gas discharge lamp ballast, including a resonant load circuit which incorporates the lamp, and includes two resonant impedances whose values determine the operating frequency of the resonant load circuit. High voltage switches are used to disconnect the lamp's filaments during the pre-heating phase.

U.S. Pat. No. 5,208,511 to Garbowicz, whose disclosure is incorporated herein by reference, describes a fluorescent lamp system which includes a ballast with primary and secondary windings and a switch for each electrode of each of the lamps in the lamp system. Each switch operates in response to the voltage across its associated lamp, such that after the lamp turns on, the switch interrupts the connection of its associated electrode to a heater winding.

Additionally, U.S. Pat. No. 5,015,923 to Nilssen, U.S. Pat. No. 5,563,473 to Mattas et al., and U.S. Pat. No. 5,677,602 to Paul et al., whose disclosures are incorporated herein by reference, describe other electronic ballasts for use with fluorescent bulbs.

SUMMARY OF THE INVENTION

It is an object of the present invention to provide an improved ballast circuit for use in a fluorescent lamp.

It is another object of some aspects of the present invention to provide improved devices and methods for pre-heating, igniting, and maintaining efficient steady-state operation of a fluorescent bulb.

It is a further object of some aspects of the present invention to provide improved devices and methods for generating a smooth transition between the pre-heating phase, the ignition phase, and the steady-state phase of a fluorescent bulb.

In preferred embodiments of the present invention, a ballast for at least one fluorescent bulb comprises two tuned resonant circuits, which resonate at substantially different respective resonant frequencies, F1 and F2, responsive to a voltage signal generated by a signal generator. The voltage signal preferably has, at any given time, substantially only one frequency component, so that the first and second resonant circuits generally do not resonate simultaneously. Resonance of the first resonant circuit preferably causes a relatively high "pre-heating" voltage to be generated in parallel across filaments of the bulb. This voltage drives current through the filaments in order to cause resistive heating of the filaments. Preferably, during this period of resonance, the voltage across the bulb (as distinguished from the voltage across each of the filaments) is maintained at a relatively low level, in order to prevent pre-ignition of the bulb. The signal generator typically continues to output the signal at F1 (the frequency corresponding to the resonant frequency of the first resonant circuit) while the filaments are increasing in temperature.

When the filaments have reached a temperature suitable for ignition of gas within the bulb, output of the signal generator preferably smoothly changes from F1 to F2, in order to: (a) substantially terminate resonance in the first circuit and thereby reduce the voltage which causes heating of the filaments; and (b) initiate resonance in the second circuit, causing a large voltage drop across the bulb, thereby causing a current to flow between the filaments in order to ignite the gas within the bulb. Thereafter, the signal generator preferably continues the smooth change in its output frequency to a third frequency, F3, which is relatively close to F2, but relatively far from F1, in order to begin a steady-state operational phase of the ballast, characterized by: (a) provision of current necessary to operate the bulb; and (b) improved efficiency relative to ballasts known in the art, due to relatively low power losses from the filaments during steady-state operation.

The ballast of the present invention thus differs from ballasts known in the art (e.g., U.S. Pat. No. 5,208,511, described hereinabove) which use switches to control pre-heating and ignition and do not use two respective resonant circuits to perform these functions. By using at least two resonant circuits with respective resonant frequencies, which are driven to resonate at different times responsive to a control signal for pre-heating, ignition, and steady-state operation of one or more fluorescent bulbs, ballasts in accordance with the present invention can be made generally less costly and more reliable than ballasts known in the art.

In some preferred embodiments of the present invention, the ballast supplies voltage to pre-heat, ignite, and support the steady-state operation of two or more fluorescent bulbs. Preferably, the two or more bulbs are connected in series, and the filaments therein are connected in parallel. Further preferably, the filaments are pre-heated in parallel, and current flows in series through the bulbs during the ignition and steady-state phases.

Preferably, the voltage drop across the bulbs (as distinguished from the drop across the filaments therein) is maintained at a low level during the pre-heating phase, in order to prevent pre-ignition, i.e., ignition of the bulbs prior to the attainment of an appropriate filament temperature. It is believed that pre-ignition damages filaments, thereby reducing the life-span of fluorescent bulbs.

Further preferably, the flow of electrons through the filaments (but not through the ionized gas), which is maintained at a high level during the pre-heating phase, is substantially reduced during steady-state operation, resulting in reduced electric power consumption.

There is therefore provided, in accordance with a preferred embodiment of the present invention, a ballast for providing electrical energy to one or more fluorescent bulbs having electrical discharge filaments, including:

a pre-heating circuit having a first resonant frequency, coupled to pre-heat the filaments;

an electron-discharge circuit having a second resonant frequency, coupled to ignite an electrical discharge through a gas between the filaments; and driver circuitry, which provides power to the pre-heating and electron-discharge circuits in succession so as to ignite the one or more bulbs by first providing power to the pre-heating circuit substantially at the first resonant frequency and subsequently providing power to the electron-discharge circuit substantially at the second resonant frequency.

Preferably, the pre-heating circuit is coupled to the filaments in parallel. Further preferably, the ballast provides energy to two or more fluorescent bulbs, such that the electron-discharge circuit is coupled in series across the filaments of the two or more bulbs.

In a preferred embodiment, the driver circuitry smoothly varies the frequency at which it provides power from the first resonant frequency to the second resonant frequency in order to terminate pre-heating and initiate ignition.

Preferably, the driver circuitry, subsequent to ignition, varies the output frequency to a third frequency, in order to drive current through the gas and cause the one or more bulbs to emit light. Further preferably, the magnitude of the current driven at the third frequency is lower than the magnitude of the current driven at the second frequency.

Preferably, when the driver circuitry provides the power at the first resonant frequency, the voltage drop generated by the electron-discharge circuit between the filaments is less than an ignition threshold of the one or more bulbs.

In a preferred embodiment, after ignition of the one or more bulbs, energy generated by the preheating circuit that is dissipated by the filaments is substantially less than energy generated by the electron-discharge circuit that is dissipated in the gas between the filaments.

There is further provided, in accordance with a preferred embodiment of the present invention, a method for providing electrical energy to one or more fluorescent bulbs having filaments, including:

generating a driving current at a first frequency to pre-heat the filaments of the one or more bulbs; and changing the driving current to a second frequency in order to ignite an electrical discharge between the filaments within the one or more bulbs.

Preferably, generating the driving current at the first frequency includes generating a resonant current flow in pre-heating circuitry coupled to the one or more fluorescent bulbs in order to drive current through the filaments.

Further preferably, generating the driving current at the second frequency includes generating a resonant current flow in electron-discharge circuitry coupled to the one or more fluorescent bulbs in order to drive current through gas between the filaments in the one or more bulbs.

In a preferred embodiment, changing the driving current includes smoothly modulating the frequency of the driving current from the first frequency to the second frequency.

Preferably, the driving current is changed from the second frequency to a third frequency in order to drive current through the gas and cause the one or more bulbs to emit light. Further preferably, the magnitude of the current driven at the third frequency is lower than the magnitude of the current driven at the second frequency.

Still further preferably, driving the current at the first resonant frequency includes providing energy to the one or more bulbs such that the voltage drop generated by the electron-discharge circuit between the filaments is less than an ignition threshold of the one or more bulbs.

In a preferred embodiment, changing the current to the second frequency includes providing energy to the one or more bulbs such that after ignition thereof, energy generated by the preheating circuit that is dissipated across the filaments is substantially less than energy generated by the electron-discharge circuit that is dissipated in the gas between the filaments.

The present invention will be more fully understood from the following detailed description of the preferred embodiments thereof, taken together with the drawings, in which:

DETAILED DESCRIPTION OF PREFERRED EMBODIMENTS

Figure 1:
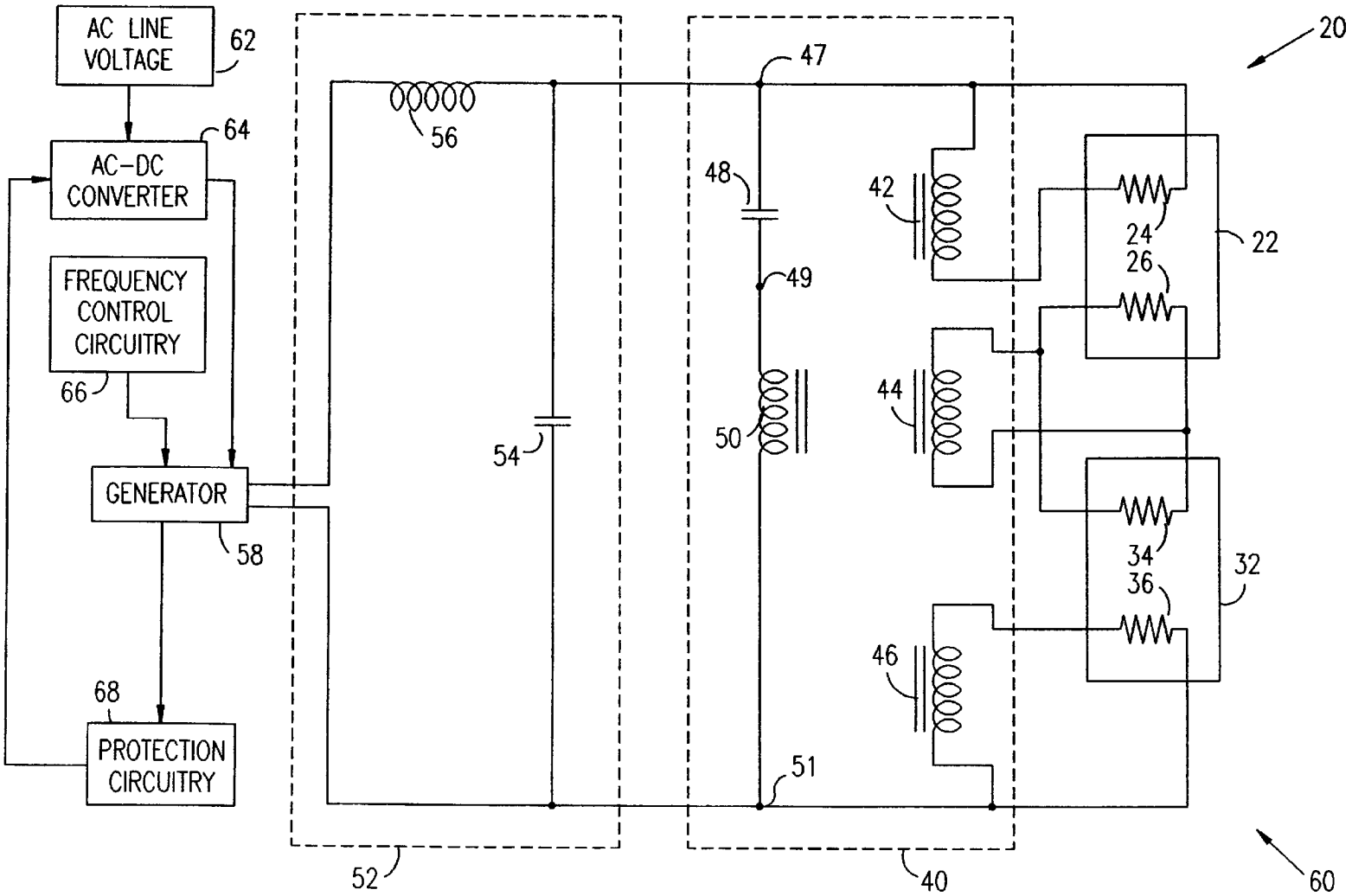
FIG. 1 is a simplified electrical schematic illustration of a fluorescent lamp including a ballast circuit, in accordance with a preferred embodiment of the present invention.

FIG. 1 is a schematic illustration of a fluorescent lamp 20, comprising two fluorescent light bulbs 22 and 32 and a ballast circuit 60 coupled to the bulbs to provide power thereto, in accordance with a preferred embodiment of the present invention. Ballast 60 preferably comprises: (a) driver circuitry, comprising a signal generator 58 coupled to an AC-DC converter 64, frequency control circuitry 66, and protection circuitry 68; (b) a resonant pre-heating circuit 40 coupled to generator 58; and (c) a resonant electron-discharge circuit 52 couple d to generator 58.

As will be described in greater detail hereinbelow, bulbs 22 and 32 are coupled to pre-heating circuit 40 so that, during a resonating phase of circuit 40, current is driven through filaments 24 and 26 in bulb 22 and through filaments 34 and 36 in bulb 32, in order to cause resistive heating of the filaments to a temperature appropriate for ignition of gas within the respective bulbs. Conversely, during resonant and near-resonant phases of electron-discharge circuit 52, bulbs 22 and 32 are ignited and sustained in a discharging phase by current driven from the resonating discharge circuit through the filaments and ionized gases in bulbs 22 and 32. By setting the values of components within resonant circuits 40 and 52 appropriately, substantially only one of the circuits resonates at any given time responsive to the output of signal generator 58. The use of two resonant circuits with separate resonating phases provides significant advantages to this embodiment of the present invention compared to ballasts known in the art, as explained hereinbelow.

Resonant pre-heating circuit 40, having a resonant frequency F1, preferably comprises a capacitor 48 in series with a transformer primary 50. When the frequency of the signal from generator 58 is near F1, the voltage drop across transformer primary 50 is relatively high (typically about 1000 volts RMS), and the magnetic field generated thereby causes current to flow through transformer secondaries 42, 44, and 46 inductively coupled thereto. Current flow induced in transformer secondaries 42, 44, and 46 sends current through filament 24, filaments 26 and 34, and filament 36, respectively, in order to generate the desired pre-heating thereof.

F1 preferably ranges from about 40 kHz to about 60 kHz. The desired frequency is typically attained by setting capacitor 48 to have a capacitance between about 1 and about 8 nF and by choosing for transformer primary 50 a winding with an inductance between about 2 and about 8 mH. The ratio of the inductance of transformer primary 50 to the inductance of each of the transformer secondaries is preferably between about 50:1 and about 100:1, and is typically approximately 70:1. It will be understood by one skilled in the art that utilizing pre-heating circuit 40 as shown in FIG. 1 is just one of many possible ways to make a resonant circuit which pre-heats filaments in a fluorescent bulb.

When pre-heating circuit 40 is near resonance, the respective voltage drops across transformer primary 50 and across capacitor 48 are high but in opposite directions, i.e., the voltage drop across capacitor 48 measured from a point 49 on one side thereof to a point 47 on another side thereof is generally similar to the voltage drop across transformer primary 50 measured from point 49 to a point 51 on the other side of transformer primary 50. Thus, even though there is relatively high current flow through transformer primary 50 during resonance of circuit 40, there is nevertheless only a very small voltage drop between point 47 and point 51. Therefore, during the resonance associated with the pre-heating phase, there is also only a small voltage drop across bulbs 22 and 32 coupled in series between points 47 and 51. The resultant small voltage drop is desirable because it avoids the inefficient, and possibly damaging, pre-ignition of bulbs 22 and 32.

Electron-discharge circuit 52, characterized by a resonant frequency F2, preferably comprises an inductor 56 coupled to generator 58 and to a capacitor 54, which capacitor is additionally coupled between points 47 and 51. During the pre-heating phase, when the output of generator 58 is at frequency F1, circuit 52 generally does not resonate. The voltage drop across capacitor 54 during the pre-heating phase is relatively low, on account of the resonance of circuit 40, as described hereinabove.

After the pre-heating phase is completed, the frequency output from generator 58 is changed, preferably smoothly, from F1 to F2, causing pre-heating circuit 40 to stop resonating and causing electron-discharge circuit 52 to begin to resonate. Responsive to the initiation of resonance in circuit 52, the voltage drop across capacitor 54—which is substantially equal to the voltage drop across bulbs 22 and 32—increases to a magnitude sufficient to initiate ignition of the pre-heated filaments. Additionally, termination of resonance in circuit 40 causes a significant decrease of the voltage drop across secondaries 42, 44, and 46, and a corresponding decrease in the current flow from the secondaries into the filaments of bulbs 22 and 32.

In order to begin a steady-state phase, output from generator 58 subsequent to ignition optionally transitions smoothly to a third frequency, F3, usually closer to F2 than to F1. By way of illustration and not limitation, typical values for F1, F2, and F3 are, respectively, 40–60 kHz, 25–35 kHz, and 22–32 kHz. Circuit 52 is preferably near resonance at F3, and generates a relatively stable current through bulbs 22 and 32 during the steady-state phase.

For most applications of the present invention, generator 58 is coupled to and powered by AC-DC converter 64, which outputs a DC voltage that is preferably greater than the peak absolute magnitude of an AC line voltage source 62 supplying electricity for ballast 60. By way of illustration and not limitation, when the line voltage is approximately 230 VAC, AC-DC converter 64 typically outputs approximately 400 VDC. Additionally, AC-DC converter 64 preferably performs power-factor correction of the AC input voltage, as is known in the art, in order to produce the desired DC output voltage.

Frequency control circuitry 66, coupled to generator 58, preferably generates a voltage signal whose magnitude determines the output frequency of signal generator 58, in order to cause resonant pre-heating circuit 40 and resonant electron-discharge circuit 52 to perform their respective functions at the proper times. Generator 58 typically comprises a standard half-bridge driver, as is known in the art, a current sensor, and circuitry to modify the output frequency of generator 58 responsive to the signal coming from frequency control circuitry 66. It is understood that there are many ways of generating a signal of varying frequency to cause resonance in two resonant circuits, and the embodiment shown in FIG. 1 is an example of one of these.

Protection circuitry 68, coupled to generator 58 and AC-DC converter 64, preferably monitors current flow from generator 58 and causes AC-DC converter 64 to substantially terminate output (thereby turning off fluorescent lamp 20) in the event of excess current draw from generator 58.

Figure 2:
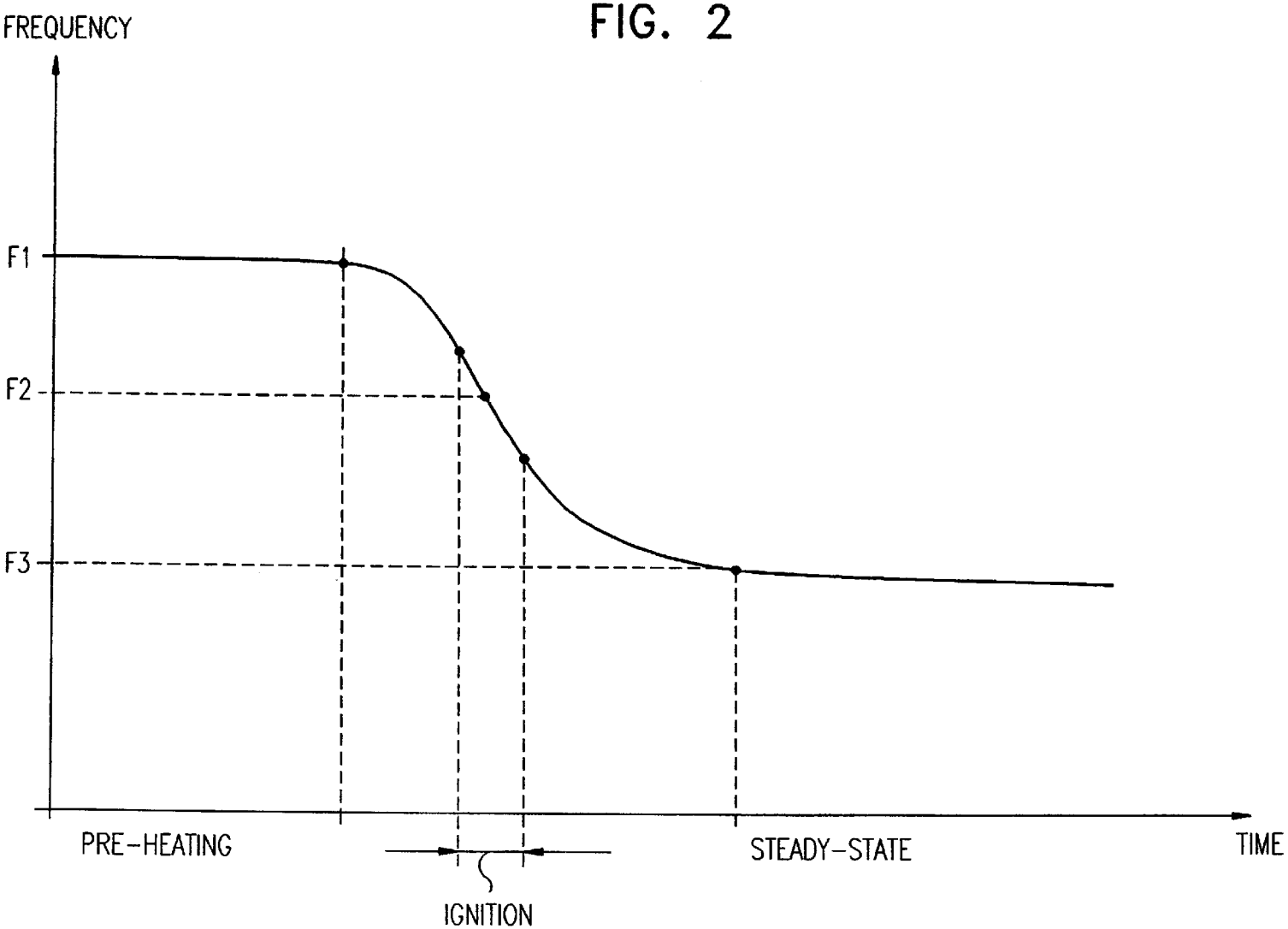
FIG. 2 is a graph showing a signal frequency as a function of time, generated within the lamp of FIG. 1, in accordance with a preferred embodiment of the present invention.

FIG. 2 is a graph showing schematically the frequency of the signal generated by generator 58 as a function of time, in accordance with a preferred embodiment of the present invention. (The graph is not drawn to scale.) As described hereinabove, frequencies F1, F2, and F3 correspond respectively to pre-heating, ignition, and steady-state phases of lamp 20. Typically, after an initial start-up period of approximately 0.5 second (not shown), the pre-heating phase begins, which lasts for approximately 1.5 seconds. After completion of the pre-heating phase, the total time for transition from F1 to F3 is typically about 100 ms, although longer or shorter time periods may be appropriate for some applications. For most applications of the present invention, the graph has a generally sigmoidal shape, as in FIG. 2, characterized by smooth transitions between each of the phases.

As will be appreciated by one skilled in the art, many techniques (using analog and/or digital circuitry) can be used to generate a signal whose frequency is smoothly changed between two fixed values. For example, generator 58 may comprise a transistor controlled by a control current so as to provide a variable resistance, and thus to modulate the frequency output.

Methods and apparatus known in the art for controlling pre-heating and ignition of a ballast typically: (a) use one resonant circuit, and thereby cause high, damaging, wattage on the filaments during steady-state operation; or (b) use one resonant circuit and additionally use switches to reduce the wattage on the filaments during steady-state operation, (e.g., as disclosed in the above-mentioned U.S. Pat. Nos. 5,208,511 and 5,175,470). In order to reduce the consumption of electricity during steady-state operation, the present invention uses two resonating circuits in place of the switches used in the prior art. The two resonating circuits preferably comprise components such as inductors and capacitors, which are typically significantly cheaper and more reliable than switches.

Preferably, after ignition of bulbs 22 and 32, energy generated by preheating circuit 40 that is dissipated by filaments 24, 26, 34 and 36 is substantially less than energy generated by electron-discharge circuit 52 that is dissipated in the gas between the filaments.

Figure 3A:
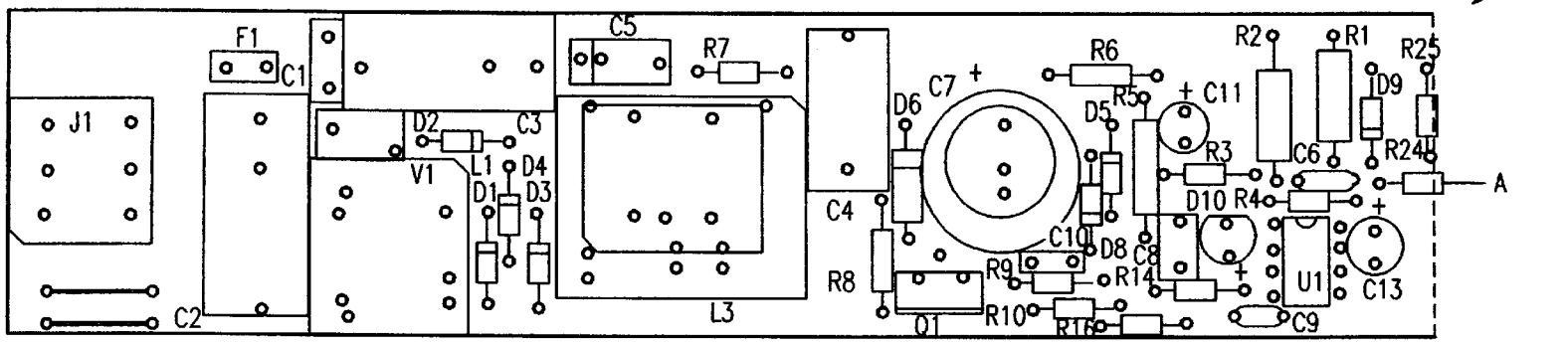
FIGS. 3A and 3B are illustrations of the left and right sides, respectively, of the circuit side of a printed circuit board, in accordance with a preferred embodiment of the present invention.
Figure 3B:
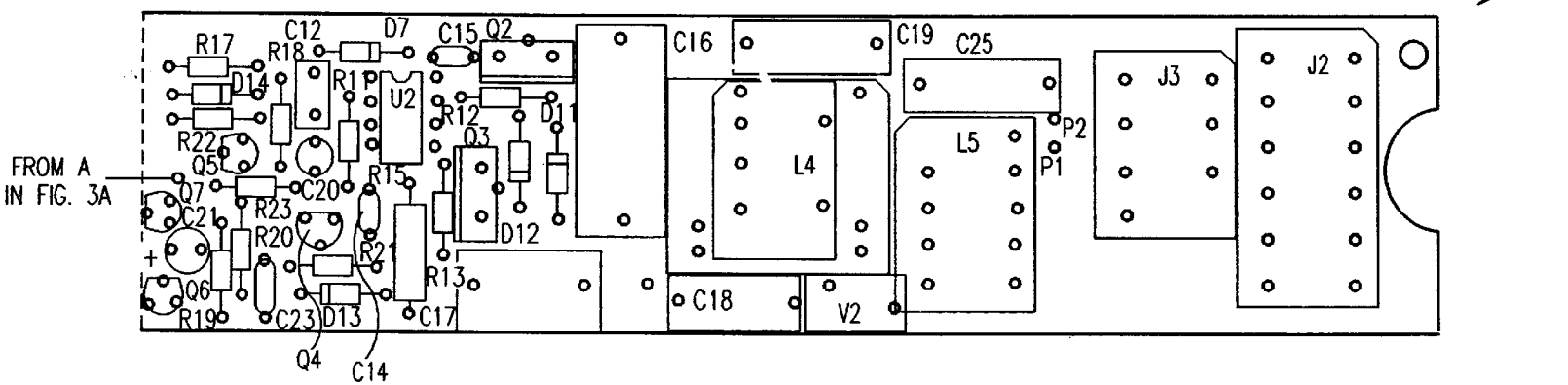
Figure 4A:
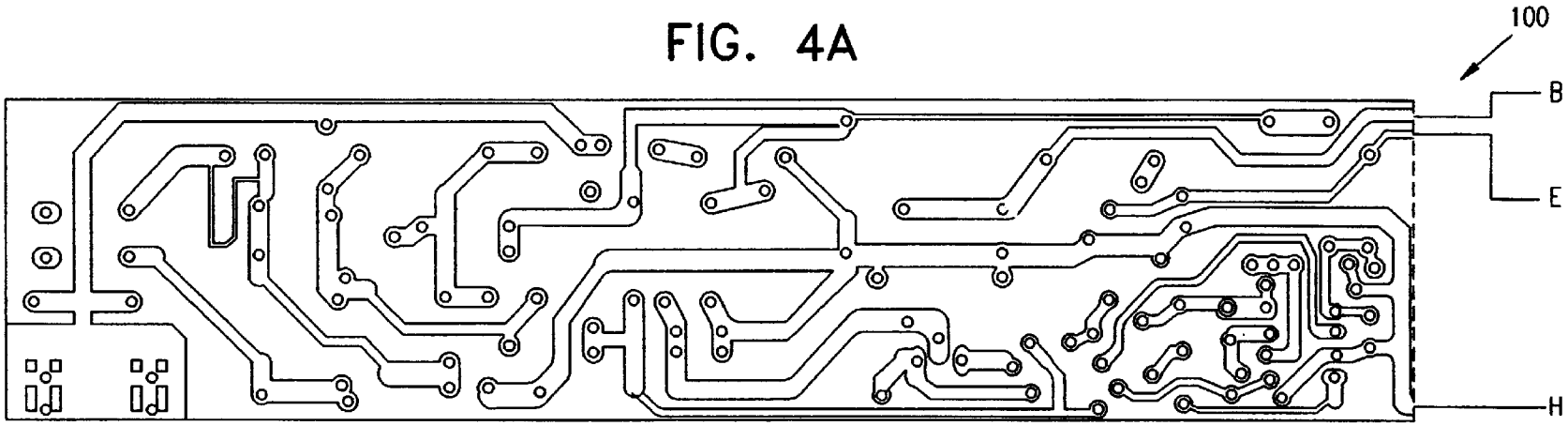
FIGS. 4A and 4B are illustrations of the left and right sides, respectively, of the mirror-image of the back side of the printed circuit board of FIGS. 3A and 3B, in accordance with a preferred embodiment of the present invention.
Figure 4B:
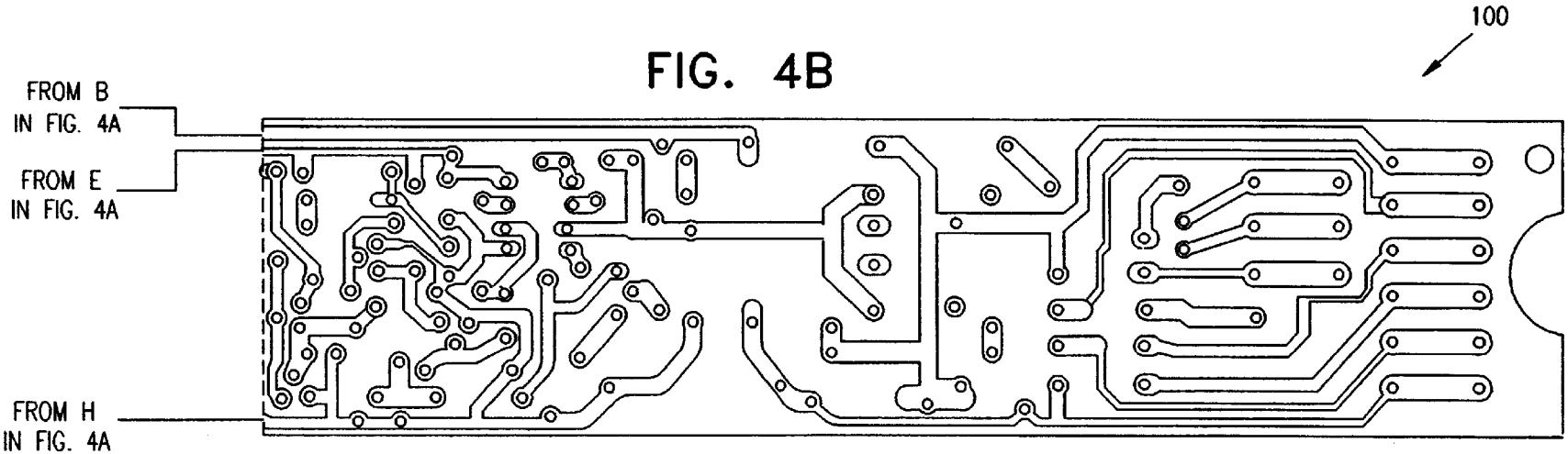

FIGS. 3A, 3B, 4A and 4B are schematic illustrations showing the layout of a printed circuit board 100 to be used in a ballast of a lamp including one, two, three or four fluorescent bulbs, in accordance with a preferred embodiment of the present invention, in accordance with the principles described hereinabove. FIGS. 3A and 3B are illustrations of the left and right sides, respectively, of the circuit side of board 100. FIGS. 4A and 4B are illustrations of the left and right sides, respectively, of the mirror-image of the back side of the board of FIGS. 3A and 3B.

Printed circuit board 100 is preferably used in one of the following configurations, which are known in the art: 1×18 W, 2×18 W, 3×18 W, 4×18 W, 1×36 W, 2×36 W, or 1×58 W. The first of these numbers refers to the number of bulbs, and the second number refers to the wattage of the bulb(s). With minor changes (not shown), board 100 can be modified to operate in the 2×58 W Compact, 2×36 W Compact, and the 2×55 W Compact configurations, as are known in the art. Board 100 preferably receives an input voltage of 230 VAC at 50 Hz, and can operate when the input voltage is between 198 VAC and 254 VAC. With minor changes, board 100 can be modified to accept 110 VAC at 60 Hz.

Terminal blocks J1 and J2 in FIG. 3B comprise coupling points for the one or more bulbs used with printed circuit board 100. Some of the components on board 100 correspond to components in ballast 60, shown in FIG. 1. For example, L4, L5, and C18 correspond respectively to inductor 56, transformer primary 50, and capacitor 54. Additionally, capacitors C19 and C25, connected in series, together perform the function of capacitor 48 in FIG. 1.

Table I below shows a list of appropriate components and values corresponding thereto which are typically used in assembling the board, although it will be understood by one skilled in the art that the principles of the present invention can be realized with different components or with a different layout of the printed circuit board.

TABLE I

| | |
|---|---|
| SEMI-CONDUCTIVE COMPONENTS | |
| RECTIFIER DIODE 1N4007 | D1, D2, D3, D4 |
| 5 mm RED LED | D10 |
| FAST DIODE 1N4937 | D12 |
| 7.5 V ZENER DIODE 1N755A or 1N755AS | D14 |
| SMALL SIGNAL DIODE 1N4148 | D5, D8, D9, D13 |
| ULTRAFAST DIODE UF1005 | D6, D11 |
| MOSFET 1RF830 | Q1, Q2, Q3 |
| JFET 2N5461 | Q4 |
| SMALL SIGNAL PNP TRANSISTOR 2N3906 | Q7 |
| SMALL SIGNAL NPN TRANSISTOR 2N3904 | Q5, Q6 |
| 430 V, 10%, 10 mm VARISTOR | V1 |
| 910 V, 10%, 10 mm VARISTOR | V2 |
| POWER FACTOR CONTROLLER KA7624B | U1 |
| HALF BRIDGE OSC. L6569 | U2 |
| INDUCTORS | |
| 36 mH | L1: QSR7041 |
| 1.35 mH | L3: QSR7063 |
| 3.92 mH | L4: QSR7049 |
| 7.7 mH | L5: Q5R7060 |
| CAPACITORS | |
| 1 nF, DISC CER CAP | C1 |
| 330 nF, METAL PYEST CAP | C2 |
| 220 nF, METAL PYEST CAP | C3, C16, C17 |
| 220 nF, METAL PYEST CAP | C4 |
| 2.2 nF, DISC CER CAP | C5 |
| 10 nF, CER CAP (Y5V) | C6, C23 |
| 10 μF, EL CAP | C7 |
| 330 nF, METAL PYEST CAP | C8, C12 |
| 1 nF, CER CAP | C9 |
| 22 nF, METAL PYEST CAP | C10 |
| 22 μF, EL CAP | C11 |
| 68 μF, EL CAP | C13 |
| 1 nF, PYEST CAP | C14 |
| 100 nF, METAL PYEST CAP | C15 |
| 5.6 nF, METAL PYPROP CAP | C18, C19, C25 |
| 10 μF, EL CAP | C20 |
| 4.7 μF, EL CAP | C21 |
| RESISTORS | |
| 200 kOhm, CARBON RES | R1 |
| 4.7 Mohm, CARBON RES | R2 |
| 12.4 kOhm, METAL FILM RES | R3 |
| 10 kOhm, METAL FILM RES | R4 |
| 787 kOhm, METAL FILM RES | R5, R6 |
| 100 Ohm, CARBON RES | R7 |
| 0.47 Ohm, CARBON RES | R8 |
| 10 Ohm, CARBON RES | R9 |
| 330 Ohm, CARBON RES | R10 |
| 32.4 kOhm, METAL RES | R11 |
| 5.1 Ohm, CARBON RES | R12, R13 |
| 7.5 kOhm, CARBON RES | R14 |
| 2.2 Ohm, METAL FILM RES | R15 |
| 22 kOhm, CARBON RES | R16 |
| 140 kOhm, METAL FILM RES | R17 |
| 100 kOhm, CARBON RES | R18, R20, R23 |
| 30 kOhm, CARBON RES | R19 |
| 8.45 kOhm, METAL RES | R21 |
| 150 kOhm, CARBON RES | R22 |
| 51 Ohm, CARBON RES | R24 |
| 3 kOhm, CARBON RES | R25 |
| TERMINAL BLOCKS | |
| 3 CONTACTS 45° TERMINAL BLOCK | J1 |
| 6 CONTACTS 45° TERMINAL BLOCK | J2 |
| 4 CONTACTS 45° TERMINAL BLOCK | J3 |

It will be appreciated generally that the preferred embodiments described above are cited by way of example, and the full scope of the invention is limited only by the claims.

What is claimed is:

1. A ballast for providing electrical energy to one or more fluorescent bulbs having electrical discharge filaments, comprising:

a pre-heating circuit having a first resonant frequency, coupled to pre-heat the filaments;

an electron-discharge circuit having a second resonant frequency, coupled to ignite an electrical discharge through a gas between the filaments; and driver circuitry, which provides power to the pre-heating and electron-discharge circuits in succession so as to ignite the one or more bulbs by first providing power to the preheating circuit substantially at the first resonant frequency and subsequently providing power to the electron-discharge circuit substantially at the second resonant frequency.

2. The ballast according to claim 1, wherein the pre-heating circuit is coupled to the filaments in parallel.

3. The ballast according to claim 1 or claim 2, wherein the ballast provides energy to two or more fluorescent bulbs, such that the electron-discharge circuit is coupled in series across the filaments of the two or more bulbs.

4. The ballast according to claim 1, wherein the driver circuitry smoothly varies the frequency at which it provides power from the first resonant frequency to the second resonant frequency in order to terminate pre-heating and initiate ignition.

5. The ballast according to claim 1, wherein the driver circuitry, subsequent to ignition, varies the output frequency to a third frequency, in order to drive current through the gas and cause the one or more bulbs to emit light, the magnitude of the current driven at the third frequency being lower than the magnitude of the current driven at the second frequency.

6. The ballast according to claim 1, wherein when the driver circuitry provides the power at the first resonant frequency, the voltage drop generated by the electron-discharge circuit between the filaments is less than an ignition threshold of the one or more bulbs.

7. The ballast according to claim 1, wherein after ignition of the one or more bulbs, energy generated by the preheating circuit that is dissipated by the filaments is substantially less than energy generated by the electron-discharge circuit that is dissipated in the gas between the filaments.

8. A method for providing electrical energy to one or more fluorescent bulbs having filaments, said method comprising the steps of:

generating a driving current at a first frequency to pre-heat the filaments of one of more bulbs, wherein the driving current is generated as a resonant current flow in pre-heating circuitry coupled to the one or more bulbs in order to be driven through the filaments; and changing the driving current to a second frequency in order to ignite an electrical discharge between the filaments within the one or more bulbs, wherein the driving current at said second frequency is generated as a resonant current flow in electron-discharge circuitry coupled to the one or more bulbs in order to be driven through gas between the filaments in the one or more bulbs.

9. The method according to claim 8, wherein the step of changing the driving current comprises smoothly modulating the frequency of the driving current from the first resonant frequency at which the driving current is driven through the filaments to the second resonant frequency at which the driving current is driven through gas between the filaments.

10. The method according to claim 8, further comprising the step of changing the driving current from the second resonant frequency to a third non-resonant frequency in order to drive current through the gas and cause the one or more bulbs to emit light, the magnitude of the current driven at the third non-resonant frequency being lower than the magnitude of the current at the second resonant frequency.

11. The method according to claim 8, wherein driving the current at the first resonant frequency comprises providing energy to the one or more bulbs such that the voltage drop generated by the electron-discharge circuit between the filaments is less than an ignition threshold of the one or more bulbs.

12. The method according to claim 8, wherein changing the current to the second frequency comprises providing energy to the one or more bulbs such that after ignition thereof, energy generated by the preheating circuit that is dissipated across the filaments is substantially less than energy generated by the electron-discharge circuit that is dissipated in the gas between the filaments.

* * * * *